US006029018A

United States Patent [19]

Rogers, IV et al.

[11] Patent Number: 6,029,018

[45] **Date of Patent: *Feb. 22, 2000**

[54] COLOR CAPABLE ELECTROPHOTOGRAPHIC PRINTER

[75] Inventors: Augustus J. Rogers, IV, West Linn; Charles F. Moore, Tualatin, both of Oreg.

[73] Assignee: Tektronix, Inc., Wilsonville, Oreg.

[ * ] Notice: This patent is subject to a terminal disclaimer.

[21] Appl. No.: 09/151,380

[22] Filed: Sep. 10, 1998

[51] Int. Cl.[7] ..... G03G 15/00

[52] U.S. Cl. ..... 399/12; 399/223; 399/28

[58] Field of Search ..... 399/12, 13, 28, 399/223, 224

[56] References Cited

U.S. PATENT DOCUMENTS

| | | | |
|---|---|---|---|
| 4,814,823 | 3/1989 | Abuyama et al. | 399/13 |
| 4,885,611 | 12/1989 | Higashio et al. | 399/13 |
| 4,952,987 | 8/1990 | Takano | 399/28 |
| 5,229,821 | 7/1993 | Fujii | 399/28 |
| 5,307,135 | 4/1994 | Amakawa et al. . | |
| 5,548,689 | 8/1996 | Poppenga et al. . | |
| 5,726,781 | 3/1998 | Isemura et al. . | |

FOREIGN PATENT DOCUMENTS

| | | |
|---|---|---|
| 60-247660 | 12/1985 | Japan . |
| 4-057069 | 2/1992 | Japan . |

*Primary Examiner*—Robert Beatty
*Attorney, Agent, or Firm*—Charles F. Moore; Francis I. Gray

[57] ABSTRACT

A color capable electrophotographic printer remains operable for monochrome printing when one or more toner cartridges are unavailable for use. Instead of reverting to an error state when a toner cartridge is missing or unavailable, the laser printer remains operable to print monochrome images or single "spot color" images using a single color and monochrome toner.

5 Claims, 6 Drawing Sheets

COLOR CAPABLE ELECTROPHOTOGRAPHIC PRINTER

TECHNICAL FIELD

The present invention relates generally to electrophotographic printers and, more specifically, to a color capable electrophotographic printer that remains operable for monochrome printing when one or more toner cartridges are unavailable for use.

BACKGROUND OF THE INVENTION

Modem color electrophotographic printers (laser printers) are significantly more expensive to acquire and operate than monochrome laser printers. A large component of this additional expense for color lasers is the requirement of four toner cartridges, as compared to a single monochrome toner cartridge for a monochrome laser printer. Additionally, the frequency of customer interventions to replace toner cartridges is generally four times higher in color laser printers as compared to monochrome laser printers.

Present color laser printers require that all four toner cartridges be installed and available for the printer to be operable. If one or more of the toner cartridges are not installed or have an insufficient supply of toner, an error message is generated and the printer will not operate until the problem cartridge or cartridges are replaced. This is the case even in the situation where a user desires to print only monochrome images using the monochrome toner cartridge which is installed and fully operable.

What is needed is a laser printer capable of full color output, but also operable with less than all four of the toner cartridges installed. Instead of remaining in an error state when a toner cartridge is missing or unavailable, the laser printer remains operable to print monochrome images or single "spot color" images using a single color and monochrome toner.

SUMMARY OF THE INVENTION

It is an aspect of the present invention to provide a color capable laser printer suitable for monochrome printing and capable of being upgraded to full color printing.

It is another aspect of the present invention that the laser printer may be selectively utilized to perform spot color printing.

It is yet another aspect of the present invention that the laser printer may utilize two or more monochrome toner cartridges for high capacity monochrome printing.

It is a feature of the present invention that an operator may be notified of a missing or empty toner cartridge and required to confirm that monochrome printing is desired.

It is another feature of the present invention that the printer may include a memory source that stores information related to whether a toner cartridge has been previously inserted into a toner cartridge port.

It is yet another feature of the present invention that the printer may include a baffle mechanism to protect the printer imaging components from ambient light when one or more toner cartridges are removed.

It is an advantage of the present invention that printing may continue after one or more toner cartridges are removed or exhausted of toner.

It is another advantage of the present invention that the color capable laser printer may be operated with only a monochrome toner cartridge, thereby lowering an initial acquisition cost of the printer.

It is yet another advantage of the present invention that the color capable printer allows "emergency printing" in monochrome or selected colors when a color toner cartridge is removed or exhausted of toner.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
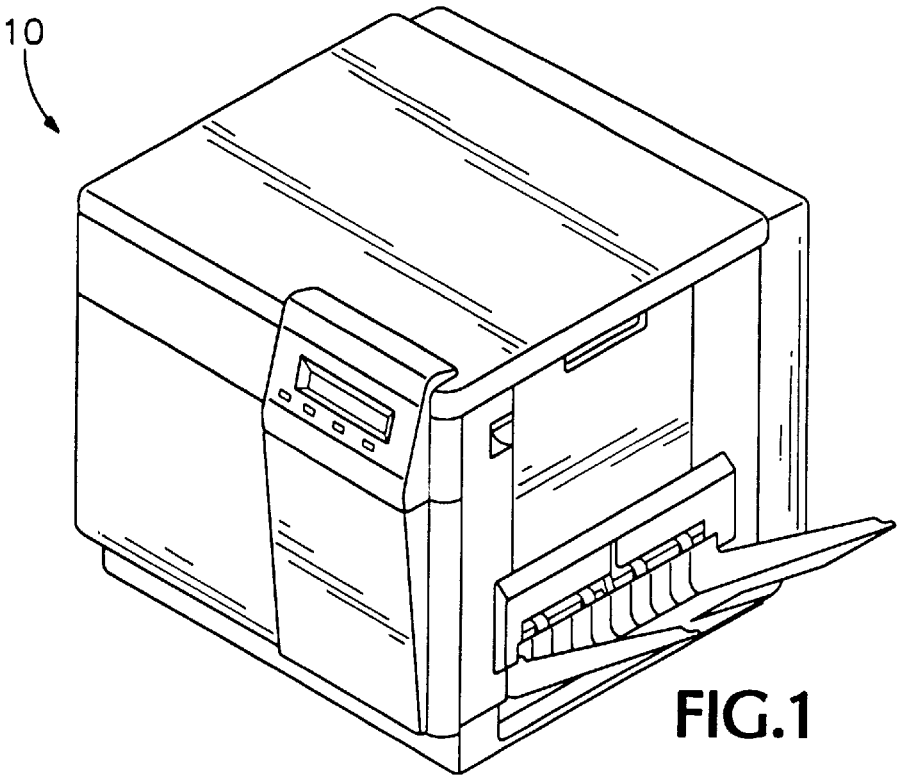
FIG. 1 is an overall perspective view of a color capable laser printer according to the present invention.

FIG. 1 is an overall perspective view of a color-capable electrophotographic printer or laser printer 10 that utilizes the method and apparatus of the present invention. The following description of a preferred embodiment of the present invention refers to its use in this type of printing apparatus. It will be appreciated, however, that the present invention may be practiced with and embodied in various other electrophotographic imaging apparatus that utilize different architectures, such as photocopiers. Accordingly, the following description will be regarded as merely illustrative of one embodiment of the present invention.

Figure 2:
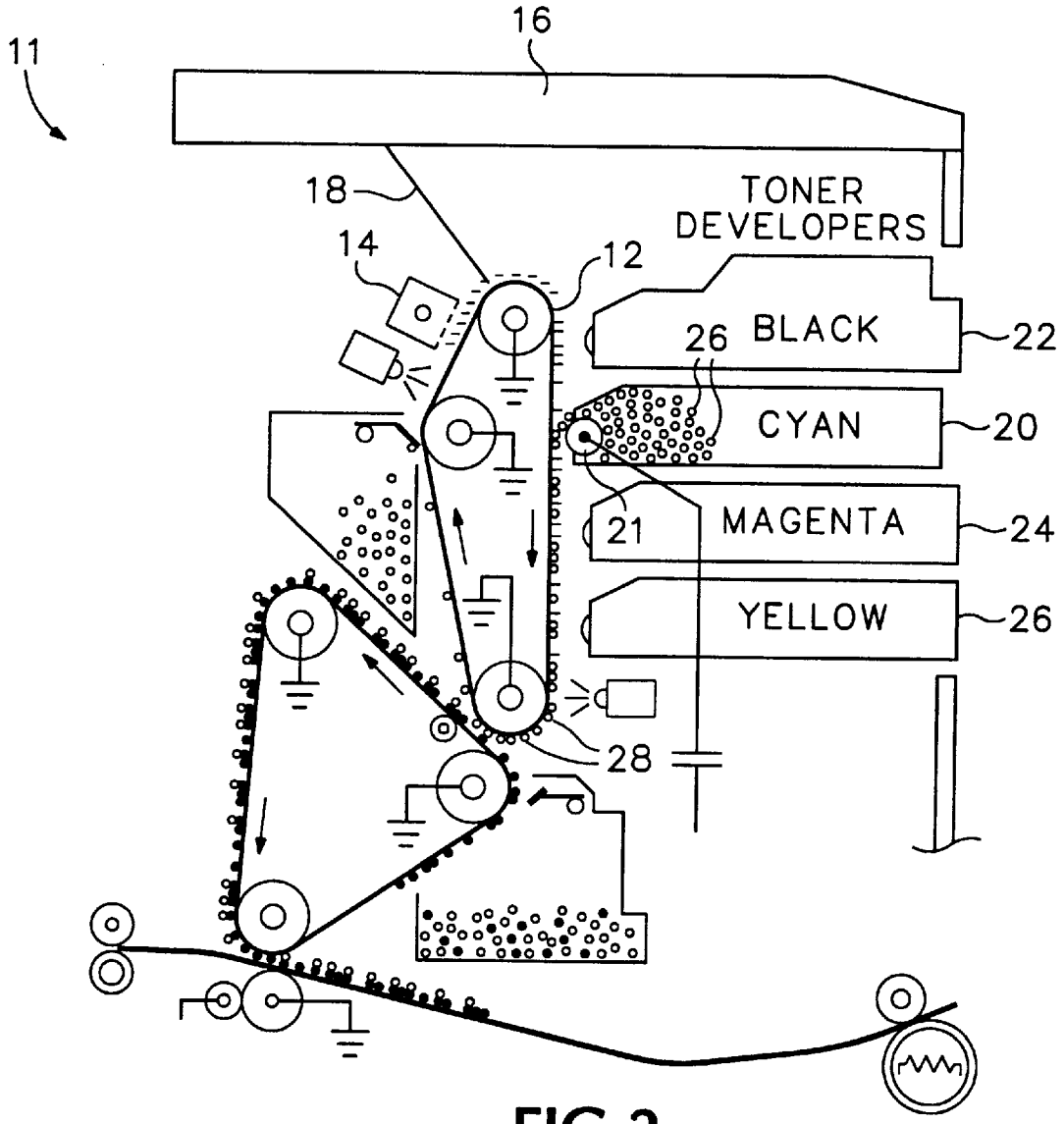
FIG. 2 is a schematic side view of a laser printing mechanism that utilizes three color toner cartridges and a single monochrome toner cartridge.

FIG. 2 is a schematic illustration of an imaging portion 11 of the laser printer 10. The imaging portion 11 includes an image receiving surface in the form of an endless photoconductive belt 12. A corona charging device or corotron charger 14 is positioned adjacent to the belt 12. The corotron charger 14 imparts a bias voltage in the form of a uniform negative charge on the belt 12 in preparation for imaging. To expose an image on the belt 12, a laser scanner 16 scans an imaging beam 18 across the surface of the belt 12. The negative electrical charges on the belt 12 are selectively dissipated as the imaging beam 18 scans across the belt to form the latent electrostatic image.

To develop the image on the belt 12 a toner cartridge, such as the cyan cartridge 20 in FIG. 2, is moved into operative contact with the belt 12 downstream of the exposure point. Cartridge 20 contains a developer roller 21 that contacts the belt 12 to transfer toner particles 28 to the belt.

Figure 5:
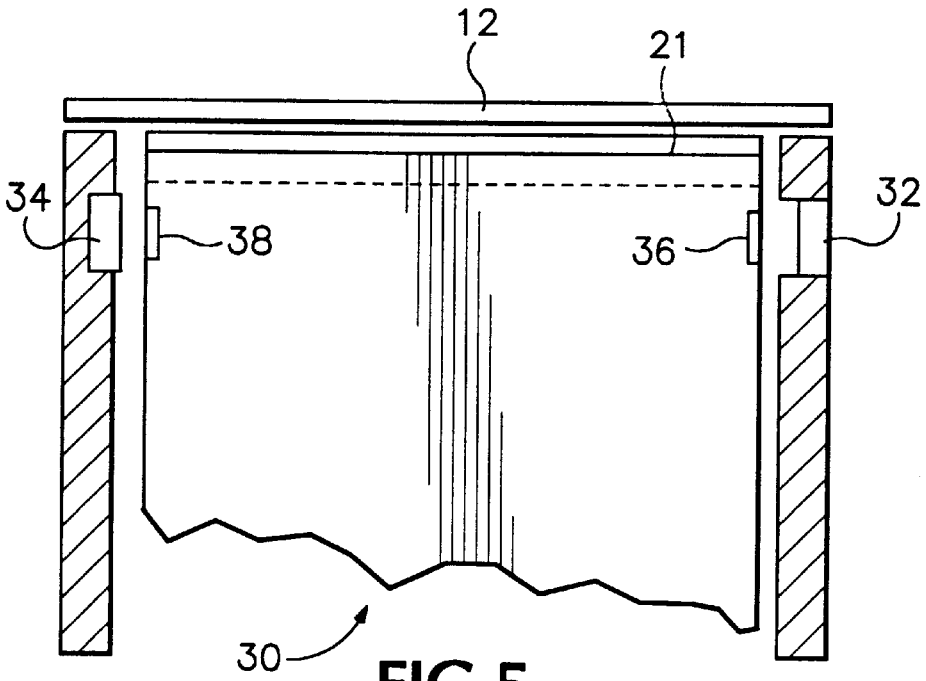
FIG. 5 is a schematic top view illustration of a toner cartridge fully inserted into a corresponding toner cartridge port.

With reference now to FIG. 5, toner cartridge 20 is shown inserted in a corresponding toner cartridge port 30. The following description applies equally to the other three toner cartridges 22, 24, and 26, as well as their corresponding toner cartridge ports. The toner cartridge port 30 includes a sensor comprising a light source 32 and a photoreceptor 34 that sense the presence of a toner cartridge in the toner cartridge port 30. The sensor also determines when a level of toner particles within the cartridge 20 falls below a predetermined level. When the toner cartridge 20 is fully inserted in the toner cartridge port 30, windows 36, 38 on either side of the cartridge are aligned with the light source 32 and photoreceptor 34. When the amount of toner particles within the toner cartridge 20 reaches a predetermined level, light from the light source 32 travels through the windows 36, 38 and is received on the photoreceptor 34 to indicate that the amount of toner particles in that cartridge is low.

The standard operating mode for a color laser printer to print full color images requires that all three of the color toner cartridges 20, 24, 26 and the monochrome toner cartridge 22 are inserted into their corresponding toner cartridge ports. Advantageously, the present invention allows printing to continue when one or more of the toner cartridges are unavailable for use . A toner cartridge may be unavailable because it is removed from its corresponding toner cartridge port, or because it is installed in the port but has exhausted its toner particle supply.

Figure 6:
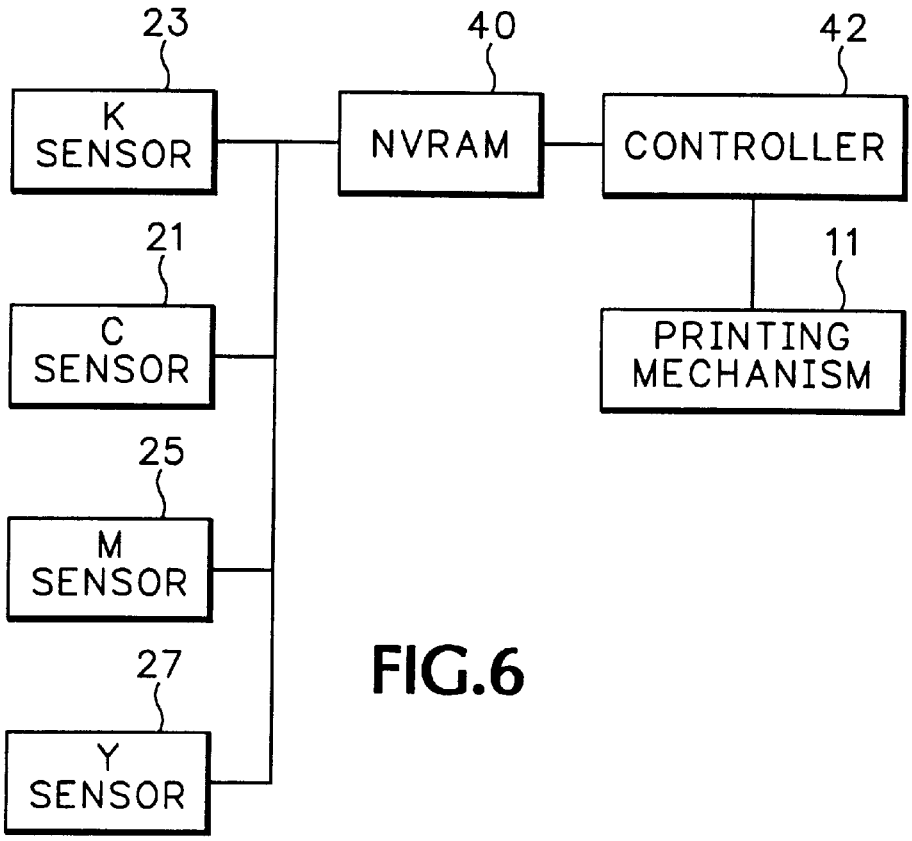
FIG. 6 is a schematic diagram showing four toner cartridge sensors in communication with a memory source, the memory source being accessed by the printer controller and utilized to control the printing mechanism.

With reference now to FIG. 6, in the preferred embodiment the printer 10 includes a memory source, such as NVRAM 40, that receives and stores information from the four sensors 21, 23, 25, and 27 in the four toner cartridge ports. A standard microprocessor controller 42 reads the information in NVRAM 40 and controls the printing mechanism 11 accordingly.

Figure 7:
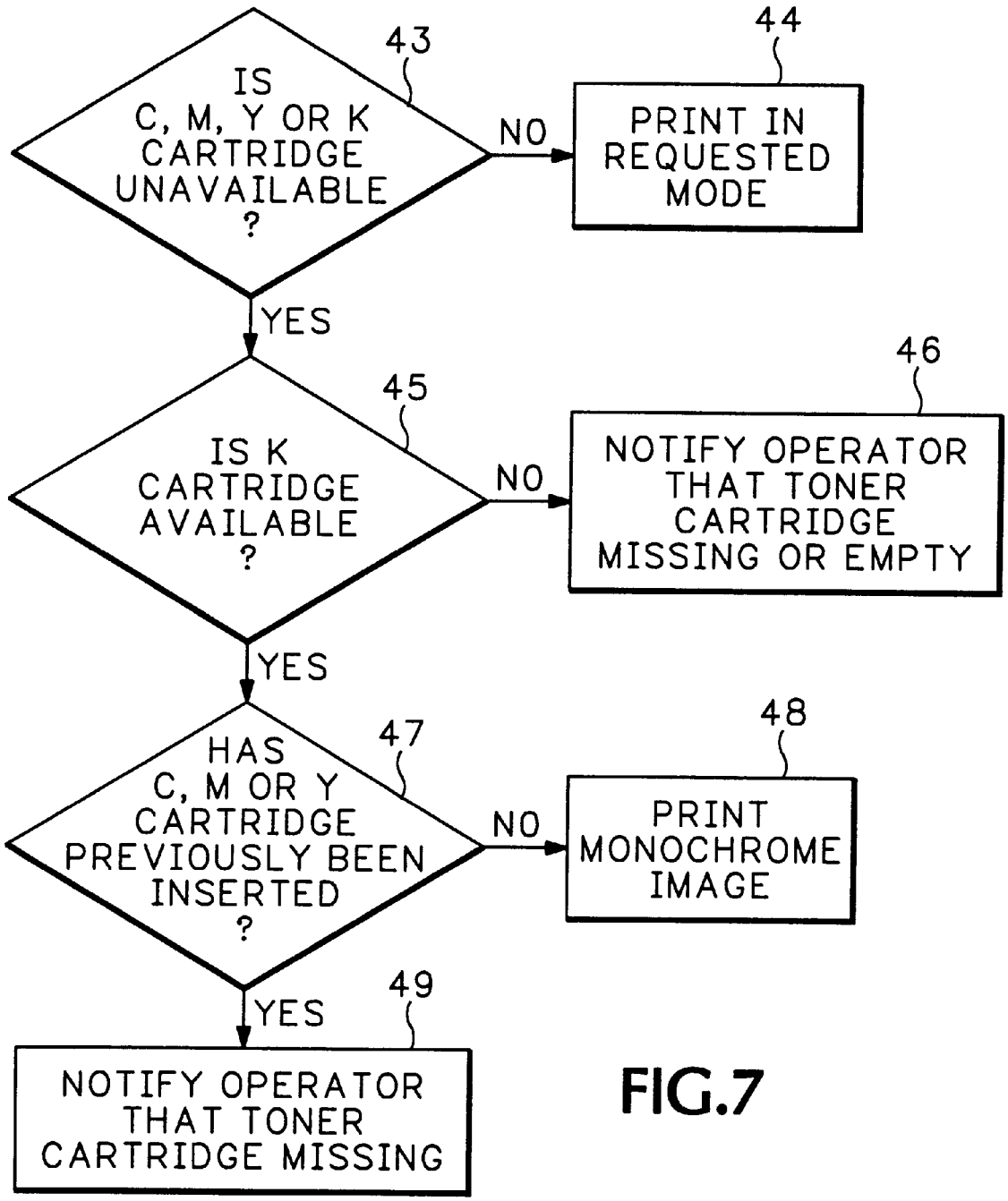
FIG. 7 is a functional flow chart illustrating the steps of a preferred method of the present invention.

With reference now to FIG. 7, a preferred embodiment of the method of the present invention is illustrated in a schematic flow diagram. In the first step 43 of the method, information from the four sensors is examined to determine whether one or more of the four toner cartridges are unavailable for use. If all of the cartridges are available for use, printing in the requested mode is enabled (step 44). If one or more of the toner cartridges are unavailable for use, the printer next determines whether the monochrome toner cartridge is available for use (step 45). If the monochrome toner cartridge is unavailable, the printer generates an error message to notify the operator that a toner cartridge requires replacement (step 46). If the monochrome toner cartridge is available for use, the printer next determines whether a color toner cartridge has previously been inserted into a corresponding toner cartridge port (step 47).

If a color toner cartridge has not previously been inserted, the printer proceeds to print a monochrome image (step 48) utilizing a monochrome toner cartridge. If a color toner cartridge has previously been inserted, an error message is generated to notify the operator that a toner cartridge requires replacement (step 49). It will be appreciated that the step of determining whether a color cartridge has previously been inserted (step 47) may be omitted, such that anytime a monochrome toner cartridge is available the printer will automatically print a monochrome image of the image data. Alternatively, this step may be replaced by the step of requiring the operator to confirm that monochrome printing is desired when a color toner cartridge is unavailable. Additionally, where one or more color toner cartridges are available, the printer may utilize one or more of these cartridges to print an image having only selected colors ("spot color" printing).

Figure 3:
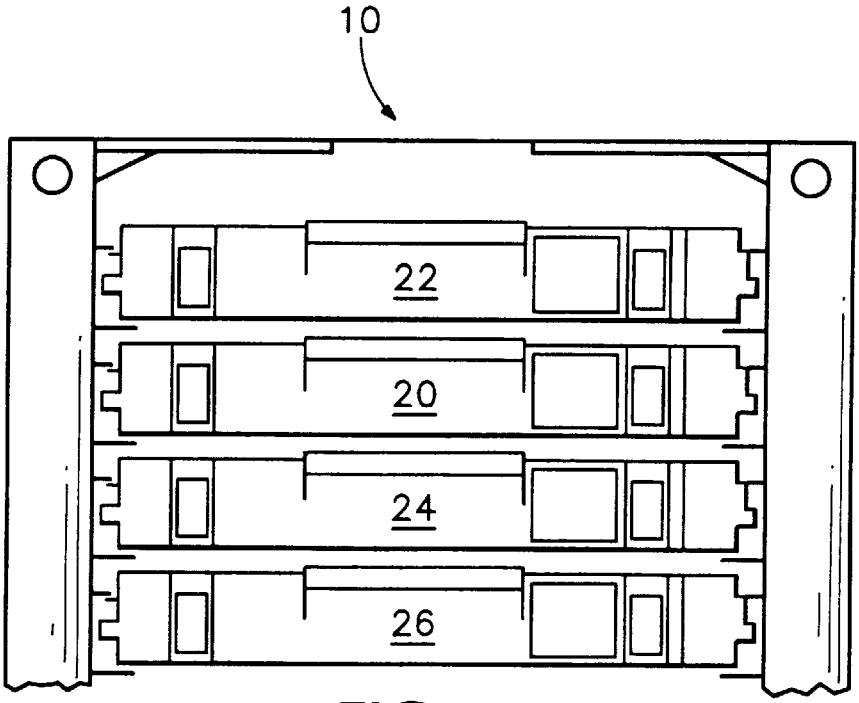
FIG. 3 is a schematic end view of a portion of the laser printing mechanism of FIG. 2 showing the four toner cartridges installed in their respective toner cartridge ports.

Returning to FIGS. 2–4, it will be appreciated that the photoconductive belt 12 is extremely light sensitive and can be damaged by prolonged exposure to ambient or other extraneous light. Preferably, the housing of the printer 10 is sealed such that minimal or no light is allowed to penetrate the housing and impinge on the photoconductive belt 12. As illustrated in FIG. 3, even where the printer housing does not provide a light-tight seal, the four installed toner cartridges 20, 22, 24, 26 occupy much of the space in the toner cartridge ports to protect the photoconductive belt 12 from light entering through the ports.

Figure 4:
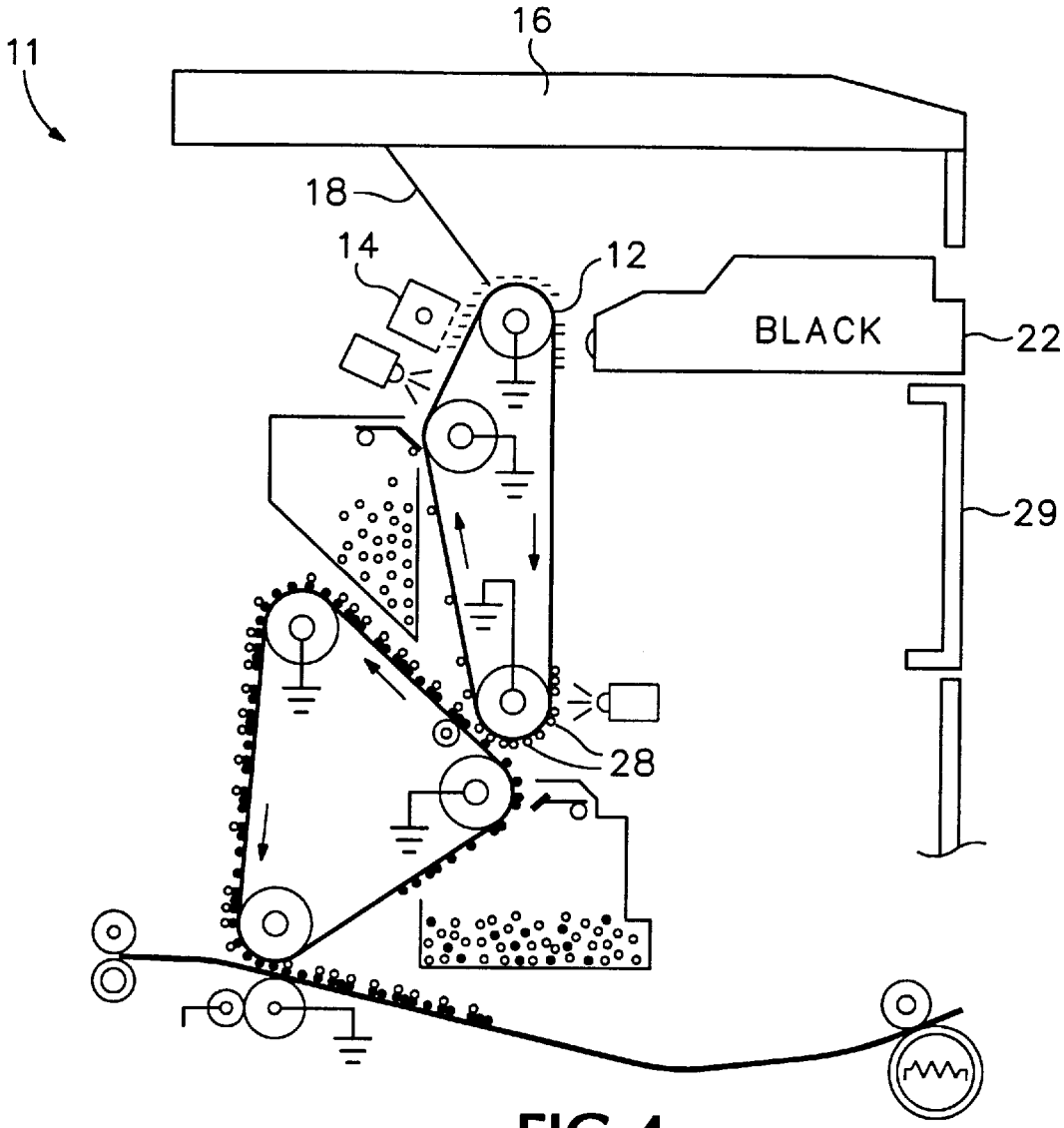
FIG. 4 is a schematic side view of the laser printing mechanism of FIG. 2 showing the three color toner cartridges removed and a removable cover positioned to block light from entering the three empty toner cartridge ports.

In one embodiment of the present invention shown in FIG. 4, the color laser printer 10 is supplied with only a monochrome toner cartridge 22, leaving empty the other three toner cartridge ports for the color toner cartridges. In this situation, an operator-removable cover 29 is provided to prevent ambient light from entering the three empty toner cartridge ports and traveling to the photoconductive belt 12. When an operator desires to upgrade the printer to color printing, the operator removes the cover 29 and inserts one or more color toner cartridges.

Figure 8:
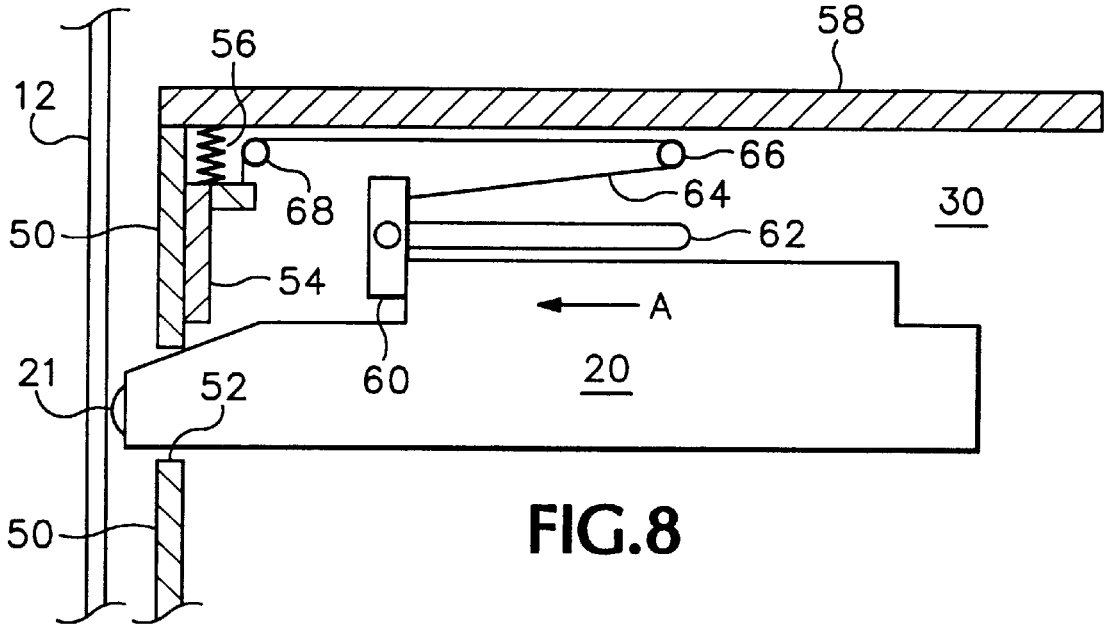
FIG. 8 is a schematic illustration of an installed toner cartridge contacting a push member to raise a baffle and expose a toner delivery aperture through which the toner cartridge extends to contact the transfer surface.
Figure 9:
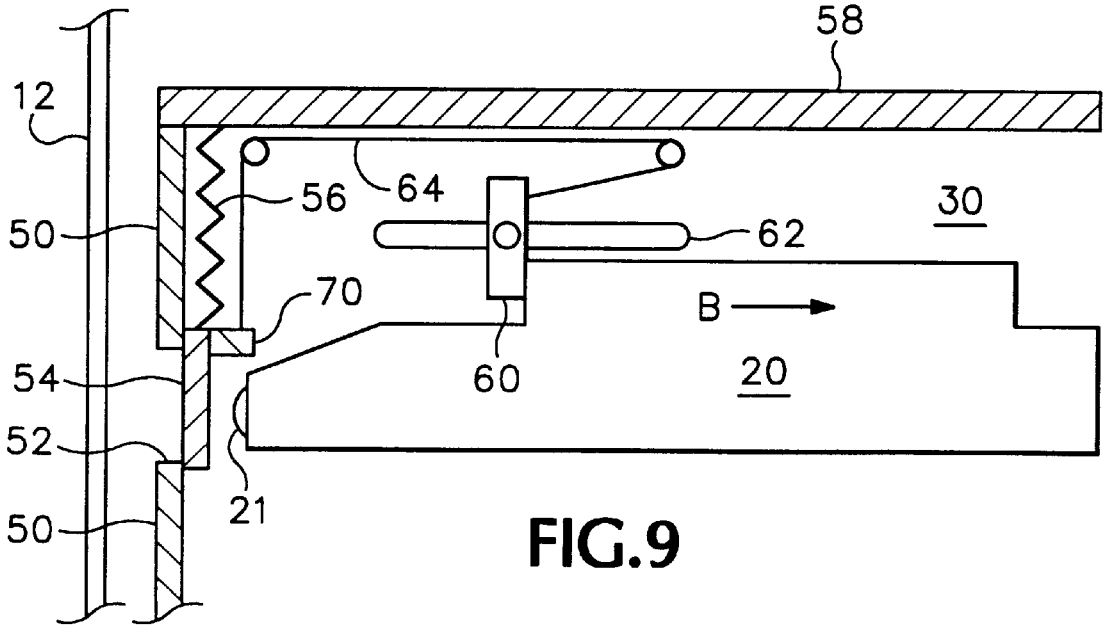
FIG. 9 is a schematic illustration of the toner cartridge FIG. 8 being removed from the toner cartridge port and the baffle moving downwardly to cover the toner delivery aperture.

With reference now to FIGS. 8 and 9, in another alternative embodiment the laser printer 10 may include a divider 50 between each toner cartridge port 30 and the photoconductive belt 12. The divider 50 includes a toner delivery aperture 52 through which the developer roller 21 in the toner cartridge 20 extends when the cartridge is fully inserted. To protect the belt 12 from ambient light, a means for covering the toner delivery aperture 52 when the toner cartridge is removed from the toner cartridge port is also provided. The means for covering the toner delivery aperture includes a baffle 54 that is connected at one end to a biaser 56, such as a coil spring. The other end of the biaser 56 is connected to a support 58 such that the biaser urges the baffle 54 downwardly. A push member 60 is spaced from the baffle 54 and slidably received in a slot 62. A connector 64 extends from the push member 60 around first and second guides 66, 68 to a flange 70 connected to the push member 54. As shown in FIG. 8, when the cartridge 20 is fully inserted in the toner cartridge port 30, the cartridge slides the push member 60 in the direction of action arrow A which in turn moves the baffle 54 upwardly to expose the toner delivery aperture 52. As shown in FIG. 9, as the toner cartridge 20 is removed from the toner cartridge port 30 in the direction of action arrow B, the baffle 54 is urged downwardly by the biaser 56 to cover the toner deliver aperture 52 and thereby prevent light transmission through the aperture. It will be appreciated that other means for covering the toner delivery aperture are possible, such as a stationary "curtain" or a fixed covering having a penetratable slit.

Those skilled in the art will appreciate that the toner cartridges described herein may comprise a toner particle container coupled with a developer roller in a single removable housing, or a separate toner particle receptacle and developer roller housing that allow individual replacement of each component. It will also be appreciated that the color toner cartridges may utilize the standard process colors of cyan, magenta and yellow, or may utilize a custom color toner for alternative spot color or full color printing.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of operating a color laser printer to print a monochrome image, the color laser printer capable of utilizing a plurality of color toner cartridges and a monochrome toner cartridge, the color laser printer including a plurality of toner cartridge ports corresponding in number to the plurality of color toner cartridges and the monochrome toner cartridge, the method comprising the steps of:

determining whether at least one of the plurality of color toner cartridges is unavailable for use;

if at least one of the plurality of color toner cartridges is unavailable for use, determining whether the monochrome toner cartridge is available for use;

if the monochrome toner cartridge is available for use, requiring an operator to confirm that printing in monochrome is desired; and if the operator confirms that printing in monochrome is desired, controlling the printer to print monochrome images of all image data sent to the printer.

2. The method of claim 1, further including the steps of:

determining whether at least one of the plurality of color toner cartridges is removed from a corresponding toner cartridge port, and if at least one of the plurality of color toner cartridges is removed from a corresponding toner cartridge port, controlling the printer to print monochrome images of all image data sent to the printer.

3. The method of claim 1, further including the steps of:

providing a memory source in the printer; and storing in the memory source information related to whether a color toner cartridge has previously been inserted in a toner cartridge port.

4. The method of claim 3, further including the steps of:

accessing the memory source to determine whether a color toner cartridge has previously been inserted in a toner cartridge port; and if a color toner cartridge has previously been inserted in a toner cartridge port, and if at least one of the plurality of color toner cartridges is unavailable for use, disabling the printer from printing until each of the plurality of toner cartridge ports contains a toner cartridge.

5. A method of operating a color laser printer to print an image containing monochrome toner and a single color toner, the color laser printer capable of utilizing a plurality of color toner cartridges and a monochrome toner cartridge, the color laser printer having a plurality of toner cartridge ports corresponding in number to the plurality of color toner cartridges and the monochrome cartridge, the method comprising the steps of:

determining whether at least one of the plurality of color toner cartridges is available for use;

if at least one color toner cartridge is available for use, determining whether the monochrome toner cartridge is available for use; and if the monochrome toner cartridge is available for use, controlling the printer to print an image containing monochrome toner and the single color toner from the at least one color toner cartridge.

* * * * *